United States Patent [19]

Robbins

[11] Patent Number: 4,848,563

[45] Date of Patent: Jul. 18, 1989

[54] DISPLAY PACKAGE AND METHOD OF MANUFACTURE

[75] Inventor: Daniel E. Robbins, Warren, Mich.

[73] Assignee: Robbins Sports, Warren, Mich.

[21] Appl. No.: 134,002

[22] Filed: Dec. 17, 1987

[51] Int. Cl.[4] ..... B65D 25/00

[52] U.S. Cl. ..... 206/45.34; 206/45.14; 206/45.31; 206/45.33; 206/315.9; 206/485; 206/588

[58] Field of Search ..... 206/45.14, 45.31, 45.33, 206/45.34, 315.9, 419, 421, 485, 588

[56] References Cited

U.S. PATENT DOCUMENTS

| | | | |
|---|---|---|---|
| 1,008,963 | 11/1911 | Ekermeyer | 206/588 |
| 1,983,499 | 12/1934 | Rosenthal | 206/315.9 |
| 2,331,010 | 10/1943 | Waters | 206/485 |
| 2,727,620 | 12/1955 | Buttery | 206/45.31 |
| 2,980,242 | 4/1961 | Miller | 206/45.31 |
| 3,048,323 | 8/1962 | Stauffer | 206/419 |
| 3,233,726 | 2/1966 | Gero | 206/45.31 |
| 3,572,574 | 3/1971 | Mears | 206/588 |
| 3,627,115 | 12/1971 | Samalon | 206/45.33 |
| 3,682,597 | 8/1972 | Husch | 206/485 |
| 3,938,661 | 2/1976 | Carmody | 206/588 |

*Primary Examiner*—David T. Fidei

*Attorney, Agent, or Firm*—John R. Benefiel

[57] ABSTRACT

A display package is disclosed particularly suited to the display of balls, in which a rectangular folded paperboard box has one corner folded inward to create a recessed vertical display space at the front of the box. A transparent tube is mounted extending vertically in the space, held by a pair of folded edge rectangular inserts received in either end of the carton and having circular cutouts into which the tube is inserted. The transparent tube holds the balls or other items to be packaged and displayed.

3 Claims, 2 Drawing Sheets

DISPLAY PACKAGE AND METHOD OF MANUFACTURE

BACKGROUND OF THE INVENTION

The present invention is concerned with packaging, and more particularly display packaging of items such as playing balls for sports i.e., table tennis balls.

Packaging of playing balls typically is in opaque box containers or tubular containers of paperboard. Tubular containers are less efficiently handled and displayed because of their round shape. Both types of packaging have not afforded anything approaching a full view display of the contents, important as a point of sale feature, since a substantially opaque exterior of the package is typically utilized for imprinting with information and promotional material. The round shape itself, of tubular containers, while efficiently holding spherical items such as table tennis balls, hinders effective presentation of promotional material on the container by the limited sight created by the curving surface thereof.

It is the object of the present invention to provide a packaging for balls or other items allowing effective package promotional marking, while prominently displaying the packaged item itself.

SUMMARY OF THE INVENTION

This and other objects of the present invention as will be appreciated by a reading of the following specification and claims are accomplished by packaging consisting of a folded paperboard rectangular carton, in which a section of one corner is folded inwardly to provide a recessed, rectangular display space. A transparent display tube containing the packaged items is mounted in the corner display space by having either end inserted in circular cutouts in respective folded inserts received in either end of the carton. The resultant packaging is essentially rectangular for convenient stacking and display and allows effectively exhibited promotional markings to be imprinted thereon, while prominently displaying the packaged items themselves in the transparent tube.

DETAILED DESCRIPTION

Figure 1:
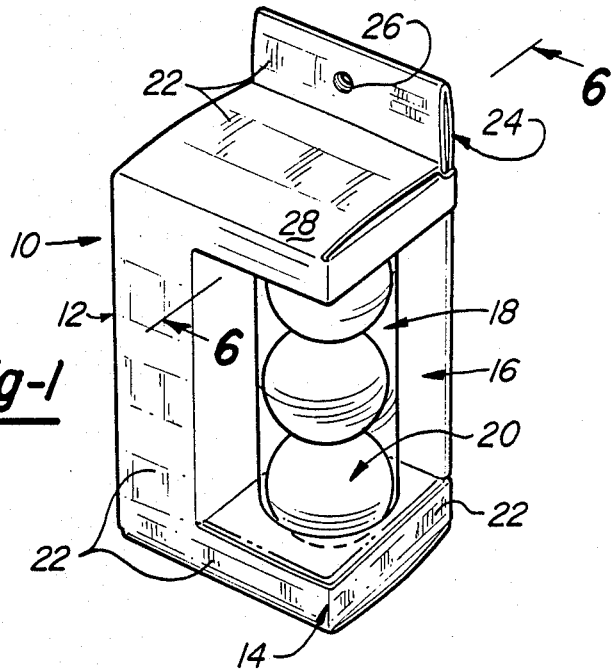
FIG. 1 is a perspective view of a display package according to the present invention.

In the following detailed description, certain specific terminology will be employed for the sake of clarity and a particular embodiment described in accordance with 35 USC §112, but it is be to understood that the same is not intended to be limiting inasmuch as the invention is capable of taking many forms and variations within the scope of the appended claims.

Referring to the Drawings, the package 10 according to the present invention is created by a generally rectangular folded paperboard carton 12 with a section of a front corner 14 completely folded inwardly to form a rectangular display space 16 extending vertically for a major fraction of the overall carton height.

A transparent display tube 18 is vertically mounted in that space 16 and has the packaged items, here shown as balls 20, disposed therein.

The remaining flat surfaces 22 are available for imprinting of promotional and informational material as indicated.

A hanging folded tab 24 extends upwardly having a hole 26 punched therein or easy hanging for exhibiting of the package 10 at the point of sale.

The carton 12 is formed with a tabbed lid 28 which when opened allows access to the items through the end of transparent tube 18.

Figure 2:
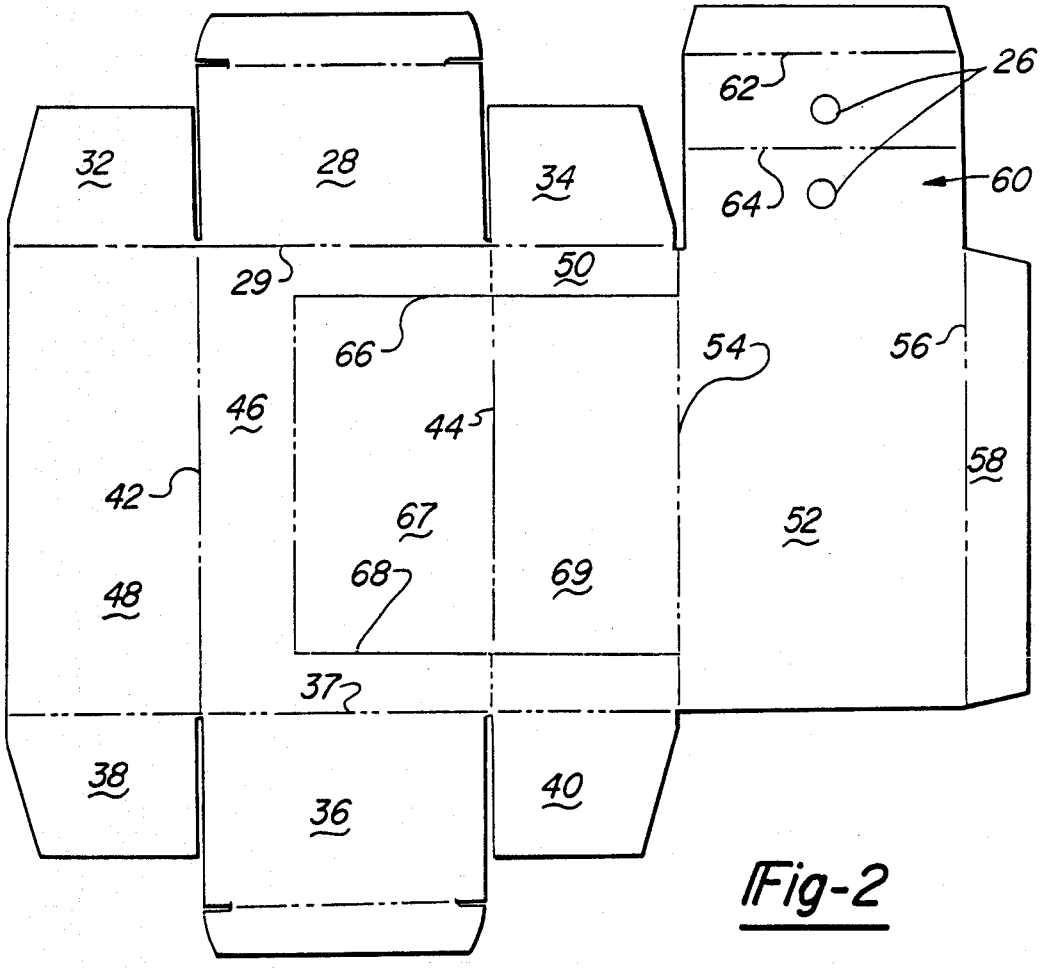
FIG. 2 is a plan view of the carton preform folded to form a part of the package shown in FIG. 1.

The carton preform 30 is cut from a sheet of paperboard, shown in FIG. 2, which is shaped to form the carton 12 with side tabs 32, 34 on either side of top cover piece 28, similar to the bottom piece 36 and side tabs 38, 40. Top fold line 29 and bottom fold line 37 define the respective top and bottom panels 28, 36.

Scored fold lines 42, 44 adjacent front panel 46 form the front corners adjacent side panels 48, 50.

Rear panel 52 has adjacent rear corner fold lines 54, 56 with a tab 58 adapted to be glued behind side panel 48.

Rear panel 52 has a protruding piece 50 with fold lines 62,64 scored therein for forming hanging tab 24 with punched holes 26.

The corner display space 16 is formed by parallel cuts 66, 68 extending from one front panel corner fold 48 towards the opposite front panel fold 42, each spaced below the upper fold line to form inside corner panels 67, 69.

Figure 3:
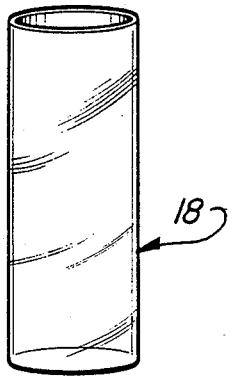
FIG. 3 is a perspective view of the transparent tube holder forming a part of the package shown in FIG. 1.
Figure 6:
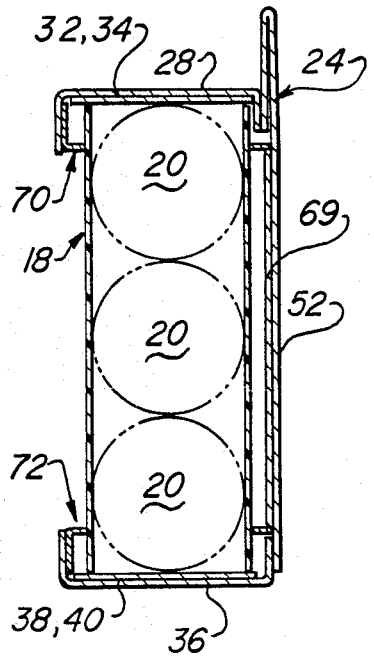
FIG. 6 is a view of the section 6—6 taken in FIG. 1.

FIG. 3 shows the transparent tube 18 formed of a relatively rigid thin walled plastic material, of a length to just lie against the inside surface of the top cover 28 and tabs 32, 34 and bottom cover 36 and tabs 38, 40 as shown in FIG. 6.

This produces a reinforcing effect supporting the carton portions overlying display space 16, and allows ready access to the contents by opening either the top cover 28 or bottom cover 36.

Figure 4:
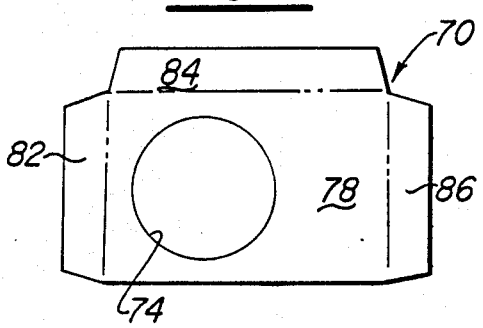
FIGS. 4 and 5 are plan views of the end pieces inserted into either end of the carton formed from the preform of FIG. 2.
Figure 5:
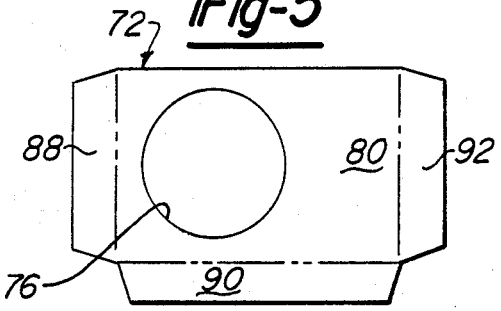

The transparent tube 18 is held located in position by a left and right hand end piece 70, 72 shown in FIGS. 4 and 5, each having a cutout hole 74, 76 in a main panel 78, 80 located to align the tube 18 in the display space 16, with the adjacent surface acting to close off the opening into the carton 12 above the display space 16.

Main panels 78 and 80 are configured to be fit within the top and bottom of the carton 12, foldable tabs 82, 84, 86, 88, 90, 92 providing a snug fit within the carton 12.

Figure 7:
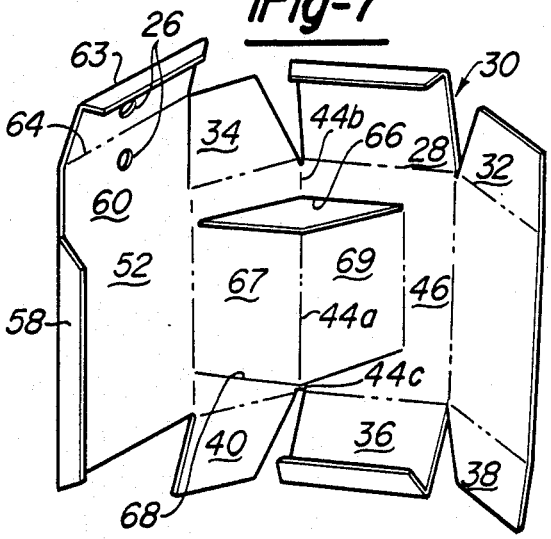
FIG. 7 is a perspective view of the carton preform of FIG. 2 partially folded.
Figure 8:
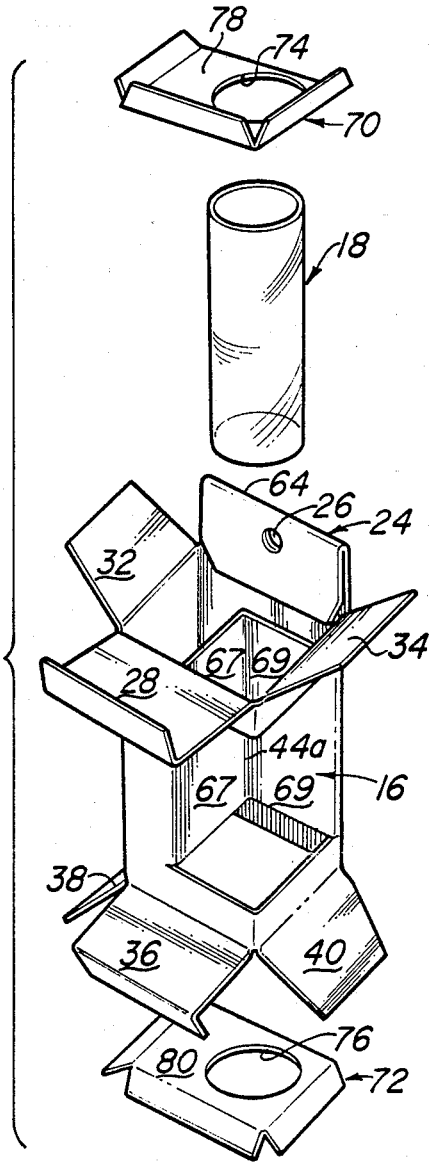
FIG. 8 is an exploded perspective view of the package shown in FIG. 1.

As shown in FIGS. 7 and 8 the preform 30 is formed into box carton 12 in conventional fashion, except that fold line **44*a* dividing the inside corner panels 67, 69 defining the display space 16 is folded inward rather than outward as with segments 44*c*, 44*b*** defining the opposite corners.

Accordingly, the package 10 provides an attractive appearance with several practical advantages, i.e., allowing prominent display of the playing balls 18, while using a sturdy rectangular carton. This allows extensive imprinting of promotional and informational material to be effectively exhibited.

I claim:

1. A package for enclosing and displaying balls or the like to be packaged, comprising:

a rectangular box carton, comprising a paperboard preform folded into a box with a front, and rear, and two side panels formed into a box, and a top and a bottom piece, said top and bottom panels hinged along one side from a respective one of said front, rear, or two side panels top allow folding over the ends of said box;

a display space at one corner of said carton defined by portions of two adjacent panels folded inwardly to form an inside corner and define said display space, said display space occupying most of the height of said carton;

a round transparent tube of a substantially rigid material, open at either end and secured extending within said display space to the top and bottom panels of said carton, said tube adapted to receive said displayed balls or the like; and, an insert fit within each end of said carton, each insert formed having a cut out, fitting to a respective end of said tube to position said tube in said display space, said inserts each overlying the top and bottom of said display space to position said rigid tube therein.

2. The package according to claim 1 wherein said tube is of a length to locate said ends against said top and bottom panels to provide support therefore.

3. The package according to claim 1 wherein said rigid tube is spaced out from said adjacent panels defining said display space to provide substantially complete viewing of said balls or the like.

* * * * *

UNITED STATES PATENT AND TRADEMARK OFFICE

CERTIFICATE OF CORRECTION

PATENT NO. : 4,848,563

DATED : July 18, 1989

INVENTOR(S) : Daniel E. Robbins

It is certified that error appears in the above-identified patent and that said Letters Patent is hereby corrected as shown below:

Column 3, line 12 (Claim 1), "top" should be --to--.

Signed and Sealed this

Twenty-fourth Day of July, 1990

*Attest:*

HARRY F. MANBECK, JR.

*Attesting Officer*

*Commissioner of Patents and Trademarks*